US005269628A

United States Patent [19]

Walbrohl

[11] Patent Number: 5,269,628

[45] Date of Patent: Dec. 14, 1993

[54] DEVICE FOR OPENING AND SUPPORTING A HEADWAY

[76] Inventor: Heinz-Theo Walbrohl, Nordstr. 73, D - 5300 Bonn 1, Fed. Rep. of Germany

[21] Appl. No.: 777,286

[22] PCT Filed: Jun. 8, 1990

[86] PCT No.: PCT/EP90/00898

§ 371 Date: May 4, 1992

§ 102(e) Date: May 4, 1992

[87] PCT Pub. No.: WO90/15222

PCT Pub. Date: Dec. 13, 1990

[30] Foreign Application Priority Data

Jun. 9, 1989 [DE] Fed. Rep. of Germany ..... 3918943

[51] Int. Cl.[5] ..... E21D 9/06

[52] U.S. Cl. ..... 405/145; 405/146

[58] Field of Search ..... 405/138, 140, 141, 142, 405/145, 146

[56] References Cited

U.S. PATENT DOCUMENTS 4,084,386 4/1978 Hohn .
4,118,938 10/1978 Unger et al. ..... 405/146 X
4,147,453 4/1979 Unger et al. .
4,265,565 5/1981 Stuckmann et al. ..... 405/145
4,437,788 3/1984 Walbrohl .
4,830,535 3/1989 Walbrohl .
4,966,494 10/1990 Inagaski et al. ..... 405/184

FOREIGN PATENT DOCUMENTS 2706244 8/1978 Fed. Rep. of Germany .
2725827 12/1978 Fed. Rep. of Germany .
3935516 5/1991 Fed. Rep. of Germany .
2336542 7/1977 France .
2380413 9/1978 France .
2203779 10/1988 United Kingdom ..... 405/145

*Primary Examiner*—David H. Corbin
*Attorney, Agent, or Firm*—Anthony J. Casella; Gerald E. Hespos

[57] ABSTRACT

A device for opening and supporting a headway in closed or open excavations comprises an envelope composed of blade- carrying heads (24) which can be driven individually or in groups, each connected to an end part. At least several end parts are designed as internal formwork sections (12) and their top surface facing the ground or soil (26) slopes backward from the corresponding top surface (38) of the corresponding blade-carrying head. The blade-carrying head (24) and the end parts are supported and guided on supporting frames (16) of a walking frame (34). A filling tube (42) for introducing supporting material (44) and binders is arranged in the region between the blade-carrying head (24) and the sections (12) of the internal casing.

10 Claims, 3 Drawing Sheets

DEVICE FOR OPENING AND SUPPORTING A HEADWAY

BACKGROUND OF THE INVENTION

Devices for opening and supporting a headway in a closed excavation are known which comprise a blade envelope consisting of blade heads and blade tails adjoining the latter. The entire blade envelope is held upon the advance by support frames. The individual support frames in the event of an open development of the blade envelope, for instance of horseshoe-shaped cross section, conduct their forces into the floor while they support the individual blade heads or blade tails. When the blade envelope is of closed cross section, the support forces counteract each other in the frames. Upon the opening, the blades are driven forward individually or in groups and the support frames are correspondingly lowered in order to follow the blade envelope in the opening direction. For the final supporting or support of the headway, a formwork device, which is also frame-shaped and has formwork elements in the end region of the blade tails, is provided. The second device serves here as inner formwork and is arranged with its outside at a distance from the rock or ground which corresponds to the inside diameter of the tunnel shell. The blade tails in this connection form the outer formwork. The supporting is effected in the manner, for instance, that concrete is introduced into the space between the bottom of the blade tails and the top of the formwork device. Upon the advance of the blade envelope, a space of a height corresponding to the thickness of the blade tails is produced between the layer of concrete and the rock or bottom. Since the blade tails serve in the region of the final supporting on the one hand as outer formwork and on the other hand support the opened tunnel cross section, said space must be filled for instance with concrete or granulate and compacted upon the advancing of the blades in order that the soil cannot cave into the space. The concrete which is to be introduced into the space is fed via conduits, each of which discharges into an outlet opening in the region of the end of the blade-tail on the rear closure edge thereof. Such a known device is used for loose soils.

In the case of firm soils, such as stone or massive rock, the tunnel opening is first predrilled and then lined with concrete by means of a sliding formwork. Such a sliding formwork can comprise supporting frames on which individual formwork sections rest, the outer guide of the entire formwork device being tapered slightly conically from front to rear as seen in the direction of advance in order to avoid constraints in the freshly concreted region along the individual formwork sections upon the advance thereof. If, namely, irregularities have been produced in the concrete, for instance by thickness tolerances and/or saggings of the sections under load in their longitudinal direction and thus constraints are exerted on the fresh concrete, such constraints would lead to considerable damage without the conical tapering. In the case of such a sliding formwork, the formwork sections serve as internal formwork elements or internal formwork sections while the firm soil serves as outer formwork. The concrete is forced, seen in the direction of advance, on the frontmost end of the slide formwork into the correspondingly sealed intermediate space, the tunnel shell which has already been lined with concrete serving as abutment.

The object of the present invention is to propose a device for the opening and supporting of a headway in closed or open excavations in soils which are not suitable for a predrilling of the tunnel opening, in which the final supporting can take place directly in the region of the blade envelope without a further formwork device having to be provided.

SUMMARY OF THE INVENTION

In the device proposed, the end parts adjoining the blade heads are used, at least in part, directly as internal formwork element or internal formwork sections. Upon the advancing of such an arrangement of the blade heads and of the following internal formwork sections, a hollow space is formed in each case between the rock or soil and the top of the internal formwork sections. In order that, upon the advancing of the blade heads, the hollow space produced over the internal formwork sections which is not supported does not immediately cave in, means for introducing self-hardening material or supporting material are provided in the region of the transition between at least one blade head and its internal formwork section. Depending on the existing circumstances and requirements, it is advantageous if some or even all internal formwork sections have means for the introduction of self-hardening material or supporting material and binder. The provision of said means at every third or fourth internal formwork section has proven particularly advantageous. Said materials are introduced continuously into the resultant hollow space upon the advance of the blade heads in order to produce the required supporting effect. In the proposed device, the blade heads and the end parts adjoining them are guided and supported on support frames of a walking frame.

Upon the advance, the apparatus is preferably so developed that all end parts which adjoin the blade heads are developed as internal formwork sections in order thereby to obtain a uniform support over the tunnel wall.

The blade heads can be connected with the internal formwork sections as a single piece or else separately. With a total length of blade head and blade-tail of generally about 10–15 meters, it is however advisable, if only from the standpoint of transportation and the development of the blade envelope prior to its introduction into the rock, to separate at least the blade heads and the internal formwork sections for transportation and assemble them then only on the spot. It can, in this connection, even be advisable to separate the internal formwork sections and/or the blade head at several places. A separation between internal formwork section and blade head can, for instance, be effected perpendicular to the principal plane thereof and, in this connection, be developed stepwise for structural reasons. With certain blade lengths, it may also be necessary to develop the blade head in two or more parts.

A particularly favorable place of connection between the parts of the blade head is at the height of the top of the internal formwork section. In this case, the lower part of the head may also be developed integral with the internal formwork section. For easy vertical displacement of the blade head even during the advance, an insertable spacer disk or at least an insertable intermediate part is arranged between the parts of the blade head.

With the device proposed, the problem may arise upon the advancing of the blade envelope that constraints occur between the internal formwork sections and the freshly concreted opening wall. For this reason, the connection between the internal formwork sections and their blade heads can be developed as an elastic or vertically adjustable coupling so that upon the advance the internal formwork section can move away from the concreted region, so that damage to the freshly concreted region can be avoided.

For the above reasons, it is provided in a preferred embodiment of the invention that the top of the internal formwork sections be at an adjustable distance from the rock or soil. This is preferably achieved in the manner that vertically adjustable, separately actuatable supports are arranged in each case in the main plane of the supporting frame between each internal formwork section and the supporting frames. In view of the adjustability of the supports, the internal formwork sections can move away from the concreted region, either individually or in groups.

The moving away of the internal formwork section is effected either on the basis of the weight itself of the internal formwork sections when their supports are loosened, or else the internal formwork sect-on is moved away from the freshly concreted region at the latest when constraints occur in the freshly concreted region due, for instance, to thickness tolerances. With the embodiment proposed, the result is at least to be obtained that the internal formwork section is not pressed so strongly against the fresh concrete upon its advance as possibly to damage it. The support between the blade head and the supporting frame associated with it should not be changed in this connection so that the blade head retains its position upon advance and when stopped. The vertically adjustable coupling between the blade head and the internal formwork section sees to it that the internal formwork section can be easily moved away. However, even if the event that blade head and internal formwork section are developed as a single part, a moving away of the internal formwork section will take place since, due to the materials used, the internal formwork section behaves like a clamped cantilevered beam, the place of clamping representing the transition between internal formwork section and blade head.

A wedge mounting between the internal formwork sections and the supporting frames constitutes here a preferred development for the actuatable support. The wedges at each support point which lie against each other and are provided at each support joint are in this connection firmly connected on the one hand to the internal formwork sections and on the other hand to the supporting frames.

A hydraulic support between the internal formwork sections and the supporting frames satisfies the same function in this connection. For structural reasons, it could also be favorable for the actuatable support between the internal formwork sections and the supporting frames to consist in part of a wedge support and in part of a hydraulic support.

It is also possible, instead of the supports described or in addition to them, to produce the internal formwork sections from separate sectional shapes between which a support or a further support is arranged. The internal formwork section then has an upper support section which faces the soil or the concreted form and a lower box section, these sections being connected by a shear-resistant coupling arranged between them. The shear-resistant coupling between the said sections sees to it that the latter can move towards each other perpendicular to the direction of the opening but are moved forwards together in the opening direction.

The support provided between the support section and the box section can in this connection be developed hydraulically and/or pneumatically. If the upper support section is to move away from the concreted region, this can take place in the manner that the hydraulic/-pneumatic support is switched from a rigid support to a resilient support. In addition, a gas-buffer support can also be provided, by which there is obtained an elastic/-resilient mounting of the upper support section on the lower box section. The control of the support can also be achieved by means of an excess pressure valve which is arranged in the hydraulic or pneumatic system. If the constraints become so great that a given pressure between the support section and the box section is exceeded, the excess pressure valve automatically assures a reduction or yielding of the support. The means for introducing self-hardening material or supporting material and binder consist of at least one feed conduit, in particular a pipeline with filling sockets the outlet opening of which is arranged on the surface of the internal formwork section or the rear of the blade head. The required supporting effect is obtained in the manner that the support material is forced continuously through such a feed conduit during the advance of the blade head into the resultant hollow space.

The supporting material may in this connection consist of granulate, while the self-hardening material, which also serves as supporting material, consists for instance of liquid concrete. A certain proportion of metal and/or plastic fibers can, if necessary, be admixed with the liquid concrete in order to increase the strength of the concrete.

When pure supporting material used for the final supporting, it is necessary that binder, for instance in the form of cement slurry or grout, be forced into the granulate. The same filling socket through which the support material is fed can be also used for the binder. However, it is more advantageous if additional means for filling the bind are provided which also consists of at least one feed conduit, particularly a pipeline with a filling socket the outlet opening of which is arranged on the top of the internal formwork section.

For the better distribution of the binder, several feed lines for the binder which have outlet openings on the top of the internal formwork sections are arranged distributed along the length of it, preferably in the rear region or section.

It should be mentioned here that the self-hardening material as well as the binder are introduced under the highest possible pressure, so that not only the hollow space itself but also the adjoining soil is permeated and compacted with self-hardening material or binders, as a result of which a stiffer supporting shell as a whole is produced.

If a sheet-metal extension or a screening plate which extends opposite the direction of opening over a part of the internal formwork section is arranged in the region of the blade head, the opening region behind the blade heads can be supported initially by the screening plate so that no rock or particles of soil can drop into the hollow space which is formed. In this way, it is possible, for instance in the case of a closed excavation, to arrange the feedlines for the supporting material and the self-hardening material at a somewhat greater distance from the blade head. By means of the screening plate which is used, an essential advantage is obtained, however, also for an open excavation, for instance, in the case of vertical excavation. Thus, first of all, all blade heads can be moved forward at most by about the length of the screening plate without concrete, for instance, being immediately forced into the hollow space. There is thus produced a continuous hollow space which extends from the top edge of the excavation to the bottom of the excavation. Steel inserts can be arranged in this hollow space prior to the concreting. It is furthermore possible to effect the concreting also from the surface, so that in the case of open excavation with the use of the screening plate feed lines can be dispensed with in the transition region between blade head and internal formwork section. It is furthermore also conceivable that, for instance, only the upper, or a few upper internal formwork sections contain the feedlines for the concrete in the case of open excavation.

In connection with the arrangement of the screening plate it is best that it be connected to the topside of the blade head facing the soil, as a result of which maximum hollow space can be obtained. It is particularly advantageous in this connection for the screening plate to extend over the entire width of the blade head. It may be desirable for narrow strips to remain free in the screening plates, through which a scarcely significant part of material falls into the hollow space but, on the other hand, the injected concrete or the injected binder penetrates beyond the screening plate into the surrounding earth.

Such a penetration of self-hardening material or binder is obtained in the manner that the screening plate consists of individual plates which are spaced from each other and are connected at their free and to the blade head. In this way, a grid-like development of the screening plate is produced. By the interruption of the plate, it is possible also in the case of this development, for the hardening material or binder to distribute itself in this surrounding region of the earth if it is introduced under sufficient pressure. The portion of the earth which falls into the hollow space with this development does not impair the strength of the formwork or wall to be produced since it mixes with the self-hardening material or binder and it is seen to it that, depending on the conditions of the soil, the distance between the individual sheet metal parts is made greater or smaller.

In another advantageous embodiment, at least some blade heads have ledges or teeth on their surface facing the rock or soil. In this case, the teeth tear the soil open and loosen it and the self-hardening material which is directly injected can penetrate into the hollow spaces produced. The use of teeth is particularly advantageous in the case of gravel or loose soils, but they may also be used in the case of other soils. In the case of gravel soils, the gravel material which drops behind the blade head into the hollow space is immediately mixed to form a favorable concrete mixture if, for instance, cement slurry or similar binders are injected instead of liquid concrete. The hardening supporting material or the binder penetrate into the loosened soil and solidify it far beyond the surface of the blade head. Specifically in the case of gravel soils, the entire gravel portion need then not first be removed from the excavation and other gravel mixed in the concrete again introduced since the gravel present can be used immediately to produce the required concrete.

The teeth are preferably spaced from each other. The development of the teeth are lengthwise teeth extending in the opening direction in one piece over the length of the blade head guarantees continuous grooves and thus a continuous shaping of the surface of the hollow space, as may be necessary under certain static conditions. This applies also to the arrangement of the tips of the teeth in one plane.

For structural reasons it is advisable to arrange the teeth on a blade head lower part the thickness of which (cross sectional height) corresponds to the thickness of the adjoining internal formwork section. The teeth on the blade head lower part are preferably removable individually or on a common lower part and thus replaceable. If vertical adjustment of the teeth is desired, this can be effected by the arrangement of at least one insertable spacer disk or at least one insertable intermediate part. Depending on the change in the nature of the rock or soil, it may be advantageous to replace a closed blade upper part by one developed with teeth.

When using blade heads with teeth applied thereon, sheet metal extensions extending in direction opposite the opening direction over a part of the internal formwork section can be arranged on the ends thereof facing the internal formwork section. If the soil should, for instance, be very loose or if too strong a penetration of material into the hollow space behind the blade head is not desired, the sheet metal extensions provided assure a partial supporting of the opening surface.

BRIEF DESCRIPTION OF THE DRAWING

The invention will be explained in further detail by way of example with reference to the preferred embodiments shown diagrammatically in the following figures.

DETAILED DESCRIPTION OF THE PREFERRED EMBODIMENT

Figure 1:
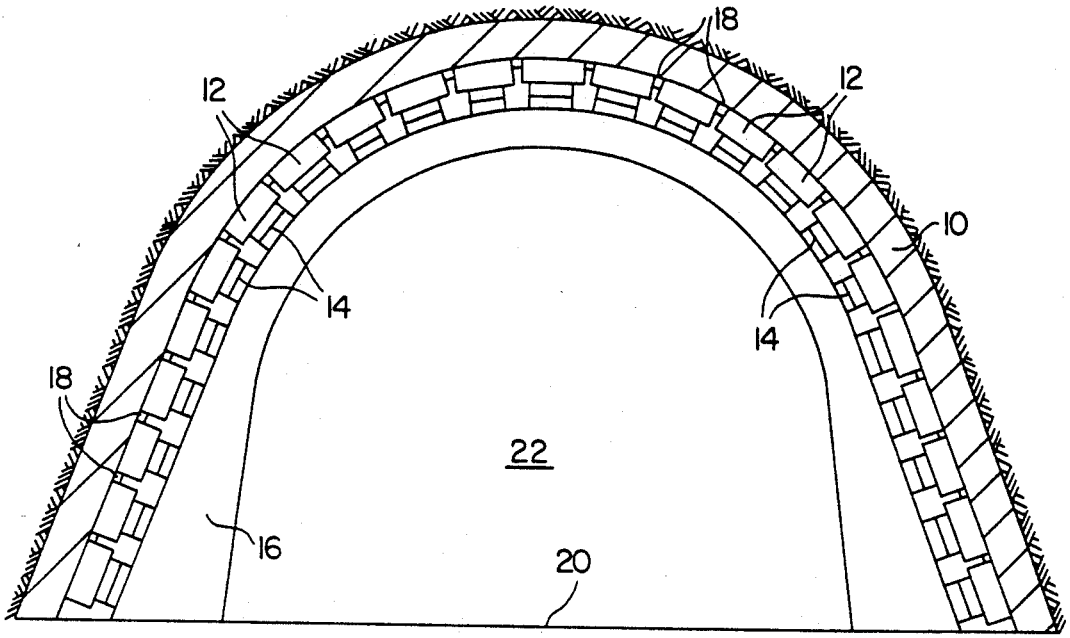
FIG. 1 is a cross section through an embodiment of the device in the case of a closed excavation, seen along the section 2—2 of FIG. 2*a;*

FIG. 1 is a cross section through an embodiment of the device in the case of closed excavation. There is diagrammatically shown a tunnel cross section, the section being taken through a completed, i.e, concreted part 10 of the tunnel Adjoining the concreted part 10 there are internal formwork elements 12 of a blade envelope. The internal formwork elements 12 are connected via supports, in the case shown wedge supports 14, to a supporting frame 16. Furthermore, between the internal formwork elements 12 there are diagrammatically shown packings 18 which prevent the emergence of fresh concrete between the internal formwork elements 12. The supporting frame 16 rests in known manner on a floor 20 of a tunnel cross section 22.

The manner of operation of the device will be explained with reference to FIG. 2a, which is a longitudinal section through the device shown in FIG. 1. The direction of advance or opening is indicated by an arrow. The section is taken through an internal formwork section 12, with a blade head 24 in front of it. The blade head 24 is developed in two parts and has a horizontal connection place 28 extending at the height of the top 26 of the internal formwork section 12. The blade head 24 and the internal formwork section 12 are together referred to as a blade 30 of the blade envelope. In FIG. 1, several adjacent blades 30 are shown distributed over the tunnel cross section 22 up to the ground. Each blade 30 rests on four support frames 16 connected in pairs, each pair of support frames 1b which is connected together by frame advance presses 32 forming a walking frame 34. For the advancing of the walking frame 34, there is required at least one frame advance press 32, several of which are provided per walking frame 34, depending on the existing conditions.

The entire blade envelope is assembled at the start of the tunnel cross section 22 which is correspondingly prepared. The blades 30 are initially arranged with their blade tips 36 in circumferential direction in a plane and are advanced individually or in groups upon the advancing movement. The tip 36 of each blade head 24 penetrates by a given step into the earth. Due to the fact that the surface 26 of each internal formwork section 12 is set back with respect to the corresponding topside 38 of the blade head 24, a hollow space is produced at the end 40 of the blade head 24, between the rock or soil - hereinafter referred to as the earth. In order that the earth does not fall into this hollow space upon the advance of the blade 30, a filling opening 42 is arranged at the end 40 of the blade head 24. In the case of the device shown in FIG. 2a, supporting material, for instance granulate 44, is continuously forced through the filling opening into the corresponding hollow space upon the advance of the blade 30. The advance of the blades 30 can take place with support by the granulate 44 in the resultant hollow space, as long as the end region 46 of the internal form section 12 still rests against the part 10 which has already been concreted. It is accordingly possible to advance the entire blade envelope in several steps by the approximate length of the internal formwork sections 12 and to support the hollow space merely with the granulate 44. In order to be able to drive the blades further, the granulate 44 must first have binders added to it, for instance cement glue. The granulate 44 and the binder then together form an additional concreted section of the tunnel shell. The binder can be fed either through the filling opening 42 or through additional injection or filling openings 48. In order that the cement glue can mix well in the hollow space, the cement glue is preferably then injected through the outward extending filling openings 48 which are distributed on the surface of the internal formwork section along its longitudinal direction. For the strength of the tunnel shell it is favorable, depending on the nature of the earth, that the cement glue not only be distributed within the hollow space but also, in part, penetrate into the earth.

After the granulate/cement-glue mixture present in the hollow space has achieved a certain strength, the blades 30 can be advanced further.

Upon the further advance, the problem may, however, arise, that constraints occur between the freshly concreted part (shell) 10 and the upper side 26 of the internal framework section 12 caused by thickness tolerances along the length of the internal formwork section 12 and transmitted to the concrete as vertical tolerances. Furthermore, adherence results between the concrete and the upper side 26 of the internal formwork shell 12. In order that the freshly concreted shell not be damaged upon the further advance of the blades, it may be desirable to switch the supporting of the internal formwork section upon the further advance from rigid pressure to resilient pressure. This can be done, as shown in FIG. 2a, for instance by wedge supports 14 between the internal formwork section 12 and the supporting frame 16. Due to the wedge support, the support of the internal formwork section 12 can be loosened, as a result of which the internal formwork section 12 moves away from the freshly concreted shell either by its own weight or, at the latest, upon the occurrence of constraints. The moving away of the internal formwork section 12 can be assisted in this connection by a vertically displaceable coupling of the internal formwork section 12 to the blade head 24. However, even with a rigid coupling or the development of internal formwork section and blade head as a single piece, the internal formwork section 12 will bend away from the blade head as a result of the elasticity of the material of the internal formwork section. The decisive factor in this connection is that the blade head 24 is not lowered during its advance. Therefore, as also shown in FIG. 2a, no wedge support is present on the supporting frame 16 which is associated with the blade head 24. If the blade head 24 is also lowered upon the advance, then the tunnel cross section would taper down correspondingly with increased advance, which is undesirable.

In the region in which granulate 44 is again fed and at the latest before the introduction again of cement glue, the internal formwork section 12 is then again lifted to its original level so that the upper side 26 of the internal formwork section 12 presses tightly against the previously concrete part. In this way, the result is obtained that, also upon the final opening, no stepwise tapering is obtained with increasing distance of advance.

Figure 2A:
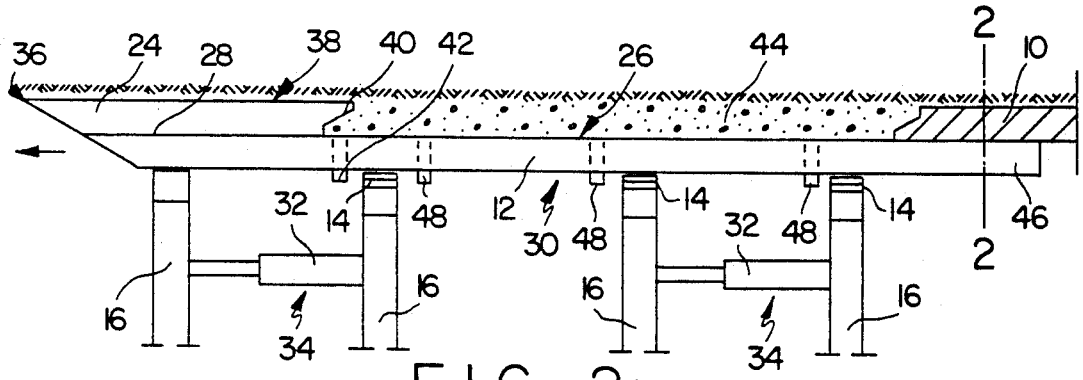
FIG. 2*a* is a longitudinal section through the device according to FIG. 1.
Figure 2B:
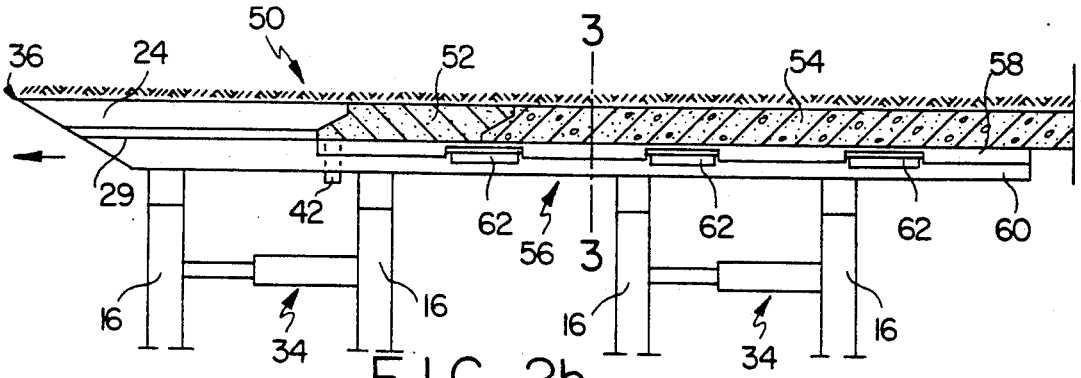
FIG. 2*b* is a longitudinal section through an alternative device.

FIG. 2b is a longitudinal section through an alternative device similar to that of FIG. 2a. Identical parts bear the same reference numbers as in FIG. 2a. The device in accordance with FIG. 2b differs from that of FIG. 2a on the one hand by the fact that instead of supporting material, a self-solidifying material is immediately injected into the hollow space produced and, on the other hand, by the fact that the vertical displaceability of the internal formwork section is solved in a different manner. Finally, between the removable upper part of the blade head 24 and its lower part there is inserted as intermediate part 29 an insertable spacer disk by which the distance between the upper side of the blade head 24 and that of the internal formwork section 56 has been increased as compared with FIG. 2a.

During the advance of a blade 50, a self-solidifying material, for instance concrete, is injected through the filling opening 42 of said blade into the hollow space produced. The injection of fresh concrete is effected continuously during the advance of each blade 50 so that the tunnel shell consists of sections concreted to each other and each of a length which corresponds to the length of the advancing step of the blades. 52 is the section which has been freshly concreted. Adjoining it, there is a concrete region 54 which has already become at least partially hard.

Figure 3B:
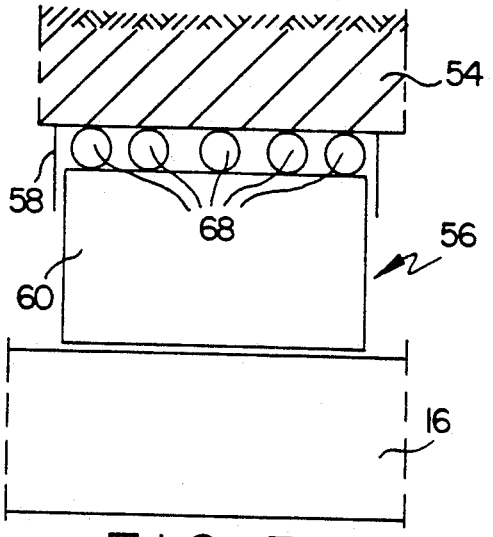
FIG. 3*b* is a section through an internal formwork section along the line 3—3 of FIG. 2*b;*
Figure 3A:
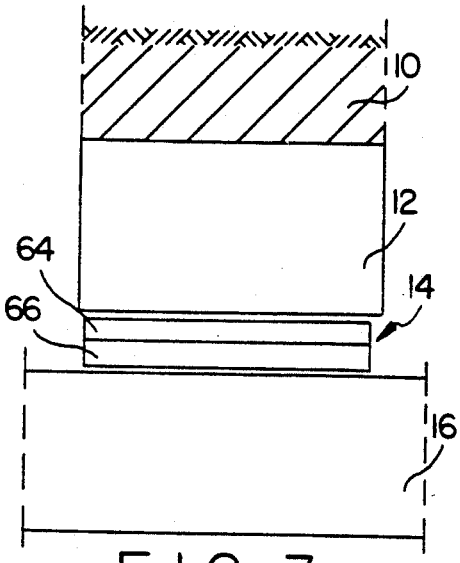
FIG. 3*a* is a section through an internal formwork section along the line 2—2 of FIG. 2*a;*

FIG. 3*a* is a section through a wedge support 14 along the line 2—2 of the embodiment of FIG. 2*a*. The wedge support 14 consists of an upper wedge 64, which is firmly connected to the internal formwork section 12, and of a lower wedge 66 which is firmly connected to the supporting frame 16. Upon the advance of the blade 30, the wedge surfaces of the wedges 64, 66 can shift somewhat, sliding on each other, and loosen the connection between the supporting frame 16 and the internal formwork section 12. In this connection, the wedges 64, 66 can move completely away from each other so that the bottom side of the internal formwork section 12 still rests only on the lower wedge 66. In this way there is obtained the desired possibility of moving the internal formwork section 12 away from concrete.

FIG. 3*b* shows a sectional view corresponding to FIG. 3*a* along the line 3—3 of the device of FIG. 2*b*. Instead of the wedge support 14, a stationary support is provided between the supporting frame 16 and an internal formwork section 56. The internal formwork section 56 consists of an upper support sectional shape 58 and a lower box section 60, the sidewalls of the upper support section 58 partially extending over the lower box section 60. Furthermore, the support section 58 and the box section 60 are connected to each other by a shear-resistant connection 62. Between the two sections 58, 60, there is provided a hydraulic and/or pneumatic support 68, which, if necessary, namely upon the advancing of the blade 50, permits the moving away of the upper supporting section 58 from the concrete 54 towards the lower box section 60, for instance by switching to an additional gas-buffer support which can be provided in the region of the support 68, whereby an elastic/resilient mounting is obtained. Instead of a gas-buffer, a hydraulic/pneumatic excess-pressure valve can also be included so that upon an increase in pressure in the hydraulic/pneumatic support 68, for instance as a result of constraints, the pressure fluid can escape via the pressure valve so that the upper support section 58 can move away from the concrete 54.

Figure 4:
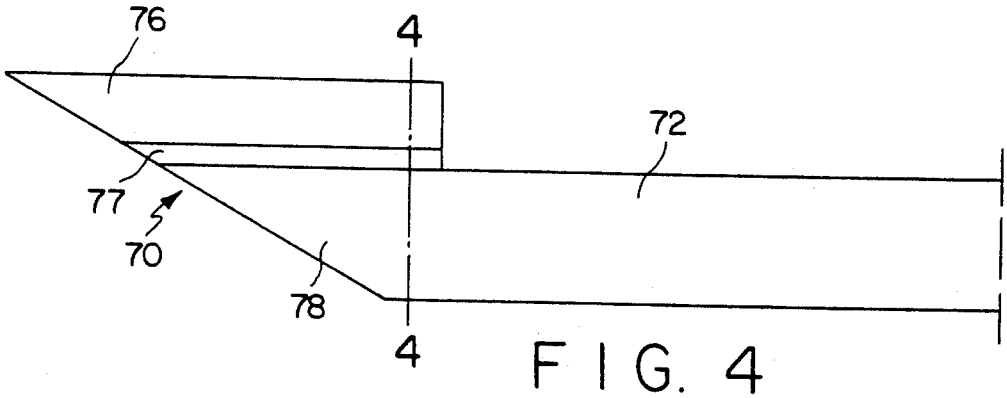
FIG. 4 is a side view of an internal formwork section with blade head.

FIG. 4 is an enlarged side view of a blade head 70 and a part of an internal formwork section 72.

Figure 5:
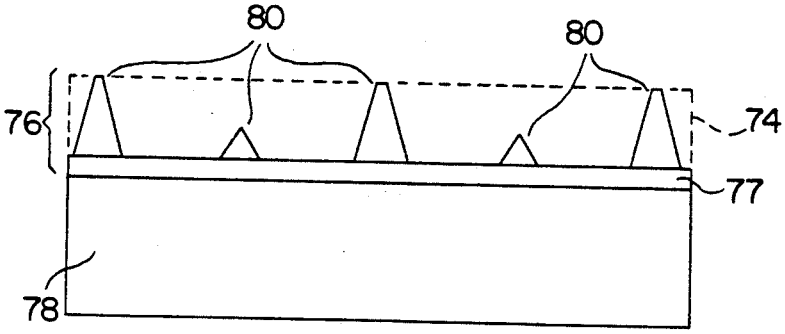
FIG. 5 is a section through the blade head along the line 4—4 of FIG. 4.

From FIG. 5, which is a section along the line 4—4 through the blade head 70 of FIG. 4, it can be seen that the blade head 70 of FIG. 4, it can be seen that the blade head 70 has a special shape. Ordinarily, the blade head 70 consists of a profile of closed cross section, as indicated by dashed line 74 in FIG. 5. It may be pointed out here that there are a large number of structural possibilities for the construction of a blade head. Thus, the blade head can be formed in a single piece and pass into the internal formwork section without a joint or place of connection. Alternatively, the blade head can be connected to the internal formwork section via a connecting place which extends perpendicular to its main plane and can possibly also be vertically adjustable. With the development with internal formwork section in accordance with the invention, a connection which extends parallel to the main plane of the blade head, similar to the connection shown at 28 in FIG. 2*a*, in which the blade head consists of an upper part and a lower part which is formed in a single piece with the internal formwork section, can be advantageous.

The blade head shown in FIGS. 4 and 5 however has the special feature that its upper part 76 consists of ledges or teeth 80 placed on an intermediate part 77. The intermediate part 77, in its turn, is placed in removable manner on a lower part 78 of the blade head. The configuration of the teeth 80 can be any desired depending on static and/or soil conditions. Thus the tips of the teeth 80 can be arranged on the same plane or be of different height. The teeth 80 can be developed in one piece as ledge as seen in the direction of advance or can be individual teeth spaced apart in the direct of advance. Such individual teeth can also be arranged distributed in any desired manner on the lower part 78. The teeth 80 tear the soil open upon advance and loosen it. The liquid concrete or granulate continuously injected upon the advance mixes with the loosened earth. The use of blade heads with teeth 80 is advantageous particularly in the case of gravel soils or comparable loose soils or mixed gravel/loose soils. In the case of gravel soils for instance, instead of liquid concrete, merely cement glue can be injected under pressure, it mixing with the gravel and resulting in the desired concrete mix. As a result of the loosening, the cement glue or other supporting material injected under pressure penetrates deep into the soil. This assures a compacting which extends far above the upper end of the teeth 80. Specifically in the case of gravel soils, the part of the loosened gravel which falls into the hollow space behind the blade head is used in order to produce a liquid-concrete mix together with the cement glue. It can thus be avoided that first of all the entire loosened gravel is removed from the advance path and then a concrete mix which also contains gravel must again be fed.

Figure 6:
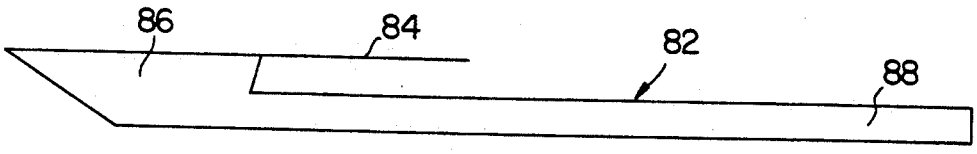
FIG. 6 is a side view of an internal formwork section with screening plate.
Figure 7:
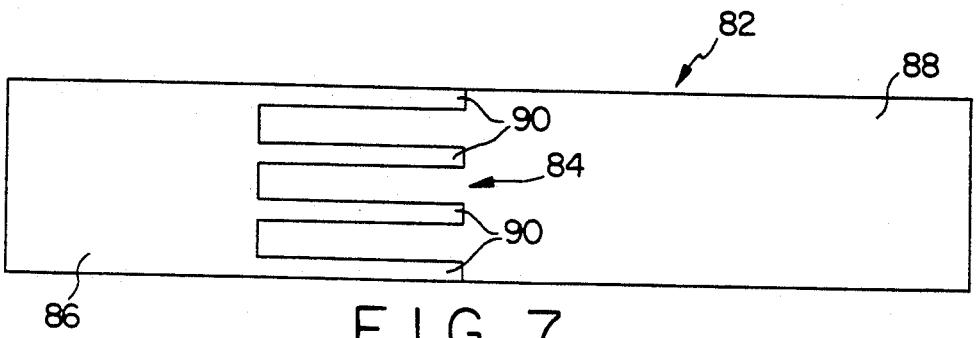
FIG. 7 is a top view of an internal formwork section with a grid-like screening plate.

FIGS. 6 and 7 show another variant of a blade 82 in side view and top view. Opposite the direction of advance, a screening plate 84 is connected to the end of a blade head 86, the plate covering a part of an internal formwork section 88. FIG. 7 shows that the screening plate 84 consists of individual plates 90 spaced from each other. The effect of the screening plate 84 is a given region of the earth can be supported or covered upon the advance. With the use of individual plates 90 the solidifying material injected under pressure or the supporting material can penetrate between the individual plates 90 into the earth in order to compact specifically certain regions. In the case of gravel soils, for instance due to the impressed pressure, a certain portion of gravel can be caused to penetrate into the hollow space behind the blade head 86 in order to mix with the injected material and become compacted.

The screening plate 84 can, however also be developed as a continuous plate covering the entire width of the internal formwork section 88. With such a development of the screening plate 84, the filling opening for the solidifying material can be arranged, for instance, in the internal formwork section 88 in the region covered by the screening plate 84. If the screening plate 84 covers completely, the blade 82 can then also be advanced by about the length of the screening plate 84 without continuously solidifying material or supporting material being injected immediately, since the earth is fully supported by the screening plate 84 and cannot penetrate into the hollow space behind the blade head 86. The screening plate 84, upon the advance, rests in this connection on the formwork which has already been at least partially solidified, so that a bending of the screening plate 84 is also avoided. Upon the advance of the blades 82 developed in this manner it is thus possible first to form a hollow space which is only then filled. In this way, it is possible both in closed and in open excavation to at least partially separate the advance of the cover and the introduction of supporting material, i.e., to carry them out separately in time. Furthermore, in such case each of the internal formwork sections does not have to have a filling opening for the solidifying material or the supporting material.

Figure 8:
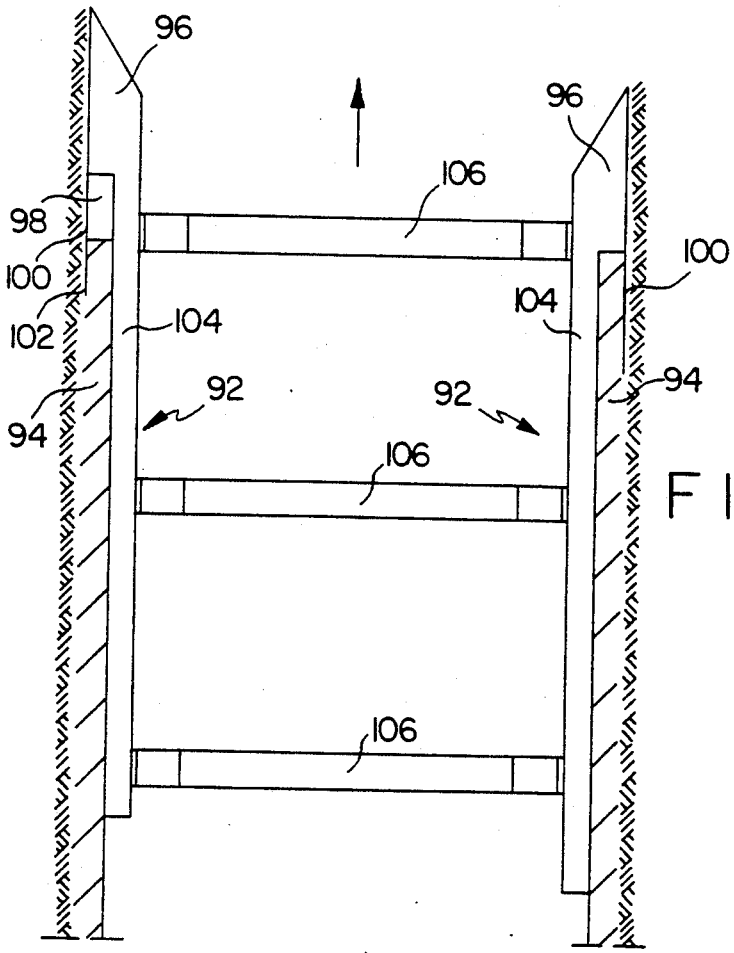
FIG. 8 is a section through an embodiment of the device in the case of open excavation.

The use of the device of the invention in open excavation and the particularly advantageous effect of screening plates behind the blade heads is shown in FIG. 8, the arrow indicating the direction of advance. In the open excavation shown, there is concerned a vertical sheeting, on the side regions of which blades 92 are arranged one above the other. On the right-hand side, the blades 92 are shown in a position in which the concreting process has been concluded. In this case, a concrete wall 94 extends up to the rear part of a blade head 96. On the left-hand side, the blades 92 are shown in a position in which they are advanced but a hollow space 98 formed behind the blade head 96 is not yet filled with concrete. There can be clearly noted here the effect of screening plates 100 which protect the hollow space 98 from the penetration of earth. Each of the screening plates 100 has its rear part 102 resting against the concrete wall 94 which has already been established as a result of which assurance is had that the screening plates 100 do not bend. When all blades 92 present on one side of the open excavation are advanced by a given step, a hollow space 98 which is continuous from the top down to the bottom is produced. Upon the advance, the topmost blade 92 lying furthest from the bottom of the excavation is advantageously begun with.

In open excavation, when using blades 92 with screening plates 100 it is of particular advantage that steel inserts can be introduced from above into the hollow space before the concreting or into freshly introduced concrete. Furthermore, it is not necessary for the internal formwork sections 104 to have introduction openings for solidifying material or supporting material since concrete can be introduced, for instance, directly from above into the hollow space 98. Also, when using the device in open excavation, the screening plates 100 can be developed in such a manner that they either cover the entire width of the internal formwork section or consist of spaced individual plates, in the manner of a grid. When spaced individual plates or for instance perforated screening plates 100 are used, the concrete introduced can penetrate into the surrounding earth and additionally may compact it.

The support for the blades 92 arranged on both sides is obtained in open excavation via supporting frames 106 which are arranged between the facing internal formwork sections 104 and head 96.

Since also in open excavation the problem can arise upon the advance of the blades 92 that the freshly concreted region is damaged by constraints, the supports or developments of the internal formwork sections 104 descried above can be used by analogy.

I claim:

1. A device for opening and supporting a headway in an excavation of rock or soil by means of a blade envelope comprising advanceable blade heads (24; 70; 86; 96), each said blade head (24; 70; 86; 96) having a top side 38, said blade heads (24; 70; 86; 96) each being connected to a top side (26) of an internal formwork section (12; 56; 72; 88; 104), said top side (26) of said internal formwork section (12; 56; 72; 88; 104) being directed toward the rock or soil; and being set back with respect to the corresponding top side (38) of the associated blade head (24; 70; 86; 96), the blade heads (24; 70; 86; 96) being guided and supported on supporting frames (16; 106) of a walking frame (34) and the formwork sections (12; 56; 72; 88; 104) being guided and supported on the supporting frames (16; 106) and means 42 for introducing self-hardening material (52) or supporting material (44) and binder being provided between at least one blade head (24; 70; 86; 96) and the respective internal formwork section (12; 56; 72; 88; 104), characterized by the fact that the top side (26) of the internal formwork sections (12; 56; 72; 84; 104) is developed adjustably with respect to its distance from the rock or soil.

2. A device according to claim 1, characterized by the fact that a support (14) is arranged vertically adjustable and separately actuatable between each internal formwork section (12; 56; 72; 88; 104) and the supporting frame (16; 106) in a plane defined by the respective support frame (16; 106).

3. A device according to claim 2, characterized by the fact that the support is arranged in the form of a wedge bearing (14) between the internal formwork sections (12) and the supporting frames (16), in which connection wedges (64, 66) are firmly connected to the internal formwork sections (12) and the supporting frames (16).

4. A device according to claim 1, characterized by the fact that internal formwork sections (56) of separate sectional shapes each have an upper support section (58) facing the rock or soil, a lower box section (60) a shear-resistant connection (62) arranged between the upper support section (58) and the lower box section (60), and a remotely controllable support (68) selected from the group consisting of a hydraulically developed support and a pneumatically developed support arranged between the upper support section (58) and the lower box section (60), with means which can selectively be turned on.

5. A device according to claim 4, characterized by the fact that the remotely controllable support (68) can be switched from a rigid support to an elastic or yieldable support.

6. A device according to claim 4, characterized by the fact that the internal formwork sections (12; 56; 72) are connected in separable manner to their blade heads (24; 70).

7. A device according to claim 6, characterized by the fact that the connection between the internal formwork sections (12; 56; 72) and their blade heads (24, 70) are vertically displaceable relative to one another.

8. A device according claim 1, characterized by the fact that the means for introduction of said material between the blade head (24; 70; 86; 96) and the respective internal formwork section (12; 56; 72; 88; 104) comprises at least one feed line with a filling socket (42) having an outlet opening section (12; 56) near the blade head (24) for introducing a granulate (44) and at least one additional feed line (48) with a filling socket on the surface (26) of the internal formwork section (12), along the surface (26) of each internal formwork section (12) rearwardly of the blade head for introducing a binder.

9. A device according to claim 1, characterized by the fact that a plurality of the blade heads (86; 96) have a screening plate (84; 100) which extends opposite the opening direction over a part of the internal formwork section (88; 104), the screening plate (84; 104) being connected with the top side of the blade head (86; 96) facing the rock or soil.

10. A device according to claim 1, characterized by the fact that at least some of the blade heads (70) have, on their top side facing the rock or soil, teeth (80) spaced from each other and extending in the opening direction.

* * * * *